US009936811B2

(12) United States Patent
Rowe, Jr.

(10) Patent No.: US 9,936,811 B2
(45) Date of Patent: Apr. 10, 2018

(54) PORTABLE SEAT AWNING

(71) Applicant: Ronald L. Rowe, Jr., Sturgis, MI (US)

(72) Inventor: Ronald L. Rowe, Jr., Sturgis, MI (US)

( * ) Notice: Subject to any disclaimer, the term of this patent is extended or adjusted under 35 U.S.C. 154(b) by 622 days.

(21) Appl. No.: 14/245,222

(22) Filed: Apr. 4, 2014

(65) Prior Publication Data

US 2015/0282626 A1 Oct. 8, 2015

(51) Int. Cl.

*A47C 7/66* (2006.01)
*E04H 15/02* (2006.01)
*E04H 15/58* (2006.01)

(52) U.S. Cl.

CPC ..... *A47C 7/66* (2013.01); *E04H 15/02* (2013.01); *E04H 15/58* (2013.01)

(58) Field of Classification Search

CPC ..... E04H 15/02; E04H 15/58; A47C 7/66; A47C 31/113

See application file for complete search history.

(56) References Cited

U.S. PATENT DOCUMENTS 2,245,312 A * 6/1941 White ..... E04H 1/1205 135/153
3,052,251 A * 9/1962 De Jean, Jr. ..... E04H 1/1205 135/117
3,155,427 A * 11/1964 Necessary ..... A47C 1/16 135/149
3,491,781 A * 1/1970 Reese ..... A47C 7/66 135/117
3,738,703 A 6/1973 Kunimatu
3,768,860 A * 10/1973 Barker ..... A47B 43/04 135/117
3,893,466 A * 7/1975 Barker ..... E04H 1/1205 135/117
4,086,931 A 5/1978 Hall
4,389,057 A * 6/1983 Richard, Jr. ..... A61G 5/10 135/90
5,096,257 A 3/1992 Clark
5,154,473 A * 10/1992 Joranco ..... A47C 7/66 135/96
5,168,889 A * 12/1992 Diestel ..... A47C 7/66 135/161
5,203,363 A * 4/1993 Kidwell ..... A47C 7/66 135/90
5,320,405 A * 6/1994 Foster ..... A47C 7/66 135/133
5,727,841 A * 3/1998 Morley ..... A47C 1/143 297/184.1
6,173,725 B1 1/2001 Garth
6,244,286 B1 6/2001 Russo
6,371,553 B1 * 4/2002 Tang ..... A47C 7/748 297/180.1

(Continued)

*Primary Examiner* — David R Dunn
*Assistant Examiner* — Danielle Jackson
(74) *Attorney, Agent, or Firm* — Larry E. Henneman, Jr.; Henneman & Associates, PLC

(57) ABSTRACT

A novel portable bleacher/bench awning includes a first seat engaging structure, a second seat engaging structure, a first frame structure, a second frame structure, and a flexible cover The first and second seat engaging structures are adapted to engage a bleacher/bench type seat. Optionally, the portable awning is collapsible. In another particular embodiment, the portable awning is adapted to be mounted to a chair via a bag that is also used to transport the portable awning.

16 Claims, 10 Drawing Sheets

(56) References Cited

U.S. PATENT DOCUMENTS

| | | | | |
|---|---|---|---|---|
| 6,789,557 | B1 * | 9/2004 | Wahl, Jr. | A47C 7/66 135/117 |
| 7,243,990 | B1 * | 7/2007 | Wahl | A47C 7/66 297/184.15 |
| 7,374,238 | B2 * | 5/2008 | Lingwall | A47C 4/52 297/129 |
| 7,475,939 | B1 | 1/2009 | Hooker | |
| 7,585,020 | B1 | 9/2009 | Wahl, Jr. | |
| 8,997,770 | B1 * | 4/2015 | Martin | A47C 7/66 135/117 |
| 9,060,613 | B2 * | 6/2015 | Combs | A47C 7/66 |
| 2002/0112752 | A1 * | 8/2002 | Blakney | A47C 7/66 135/96 |
| 2013/0069400 | A1 * | 3/2013 | Nikolic | A47C 4/286 297/184.15 |
| 2013/0214565 | A1 | 8/2013 | Nickell | |
| 2014/0306494 | A1 * | 10/2014 | Frankel | A47C 7/66 297/184.15 |

* cited by examiner

PORTABLE SEAT AWNING

BACKGROUND OF THE INVENTION

Field of the Invention

This invention relates generally to awning devices, and more particularly to portable awning devices. Even more particularly, this invention relates to portable awning devices configured for attachment to seating.

Description of the Background Art

Bleachers and benches are among the most common forms of seating in many outdoor event venues. In general, bleachers and benches are intended to provide the most cost effective solution to seating as many spectators as possible. In achieving this goal, personal comfort and protection from the elements (i.e., rain, sun, wind, etc.) is often sacrificed.

In effort to increase personal comfort and protection from the elements while attending outdoor events, many types of canopy devices have been developed. For example, U.S. Pat. No. 4,086,931 (Hall) teaches an umbrella shelter that is adapted to detachably mount to a stadium bench. The umbrella includes a base that hooks around a bench and includes a vertical pole socket. The pole socket supports an umbrella pole that further supports an umbrella frame. The umbrella frame includes a number of structures (e.g., ribs, struts, spring elements, etc.) that support a piece of fabric.

Although the umbrella shelter of Hall provides some protection from the elements, there are several disadvantages inherent to the design. For example, umbrellas are structurally unstable in high winds. As another example, the umbrella shelter design of Hall is relatively complicated in that it includes a high number of moving parts. Consequently, the umbrella shelter of Hall is difficult to use and transport.

What is needed, therefore, is a portable canopy device that is capable of withstanding extreme conditions. What is also needed is a portable canopy device having a less complicated design that is easier to operate and more convenient to transport.

SUMMARY

The present invention overcomes the problems associated with the prior art by providing a portable seat awning that can be coupled to either a bleacher/bench style seat or a lawn chair.

The portable seat awing includes a first seat engaging structure, a second seat engaging structure, a first frame structure, a second frame structure, and a flexible cover. The first seat engaging structure is disposed on a first side of the portable seat awning. The second seat engaging structure is disposed on a second side of the portable seat awning. The first frame structure is coupled to the first seat engaging structure and is disposed on the first side of the portable awning. The second frame structure is coupled to the second seat engaging structure and is disposed on the second side region of the portable awning. The flexible cover includes a first region that is coupled to the first frame structure and a second region that is coupled to the second frame structure.

In an example embodiment, the first seat engaging structure and the second seat engaging structure are horizontally adjustable to accommodate for various seat depths (i.e., front to back dimension). In a more particular example embodiment, the first seat engaging structure includes a first portion and a second portion. The first portion of the first seat engaging structure is adapted to engage a top surface of a seat, and the second portion of the first seat engaging structure is adapted to engage a bottom surface of the seat. The first portion of the first seat engaging structure and the second portion of the first seat engaging portion are coupled in a telescoping relationship. The second seat engaging structure includes a first portion and a second portion. The first portion of the second seat engaging structure is adapted to engage a top surface of the seat, and the second portion of the second seat engaging structure is adapted to engage a top surface of the seat. The first portion of the second seat engaging structure and the second portion of the second seat engaging portion are coupled in a telescoping relationship. In an even more particular example embodiment, the first portion of the first seat engaging structure is coaxially aligned with the second portion of the first seat engaging structure, and the first portion of the second seat engaging structure is coaxially aligned with the second portion of the second seat engaging structure. The first portion of the first seat engaging structure is pivotally coupled to the second portion of the first seat engaging structure, and the first portion of the second seat engaging structure is pivotally coupled to the second portion of the second seat engaging structure.

In the example embodiment, the first seat engaging structure is pivotally coupled to the first frame structure, and the second seat engaging structure is pivotally coupled to the second frame structure. In addition, the first seat engaging structure includes a first arm rest, and the second seat engaging structure includes a second arm rest. The first frame structure and the second frame structure are both adapted to engage a rear surface of a seat.

An example first frame structure includes a first vertical section and a first horizontal section, and an example second frame structure includes a second vertical section and a second horizontal section. The example portable seat awning further includes a third horizontal section coupled between the first vertical section and the second vertical section, and a fourth horizontal section coupled between the first horizontal section and the second horizontal section. The first horizontal section and the second horizontal section are coupled to the forth horizontal section.

In the example embodiment, the third and fourth horizontal sections of the portable seat awning are both collapsible. In addition, the first horizontal section of the first frame structure is collapsible with respect to the first vertical section of the first frame structure. Similarly, the second horizontal portion of the second frame structure is collapsible with respect to the second vertical section of the second frame structure.

Also, in the example embodiment, the first vertical section of the first frame structure includes an upper portion and a lower portion. The upper portion of the first vertical section is coupled to the first horizontal portion, and the tower portion of the first vertical section is coupled to the first seat engaging structure. Similarly, the second vertical section of the second frame structure includes an upper portion and a lower portion. The upper portion of the second vertical section is coupled to the second horizontal portion, and the lower portion of the second vertical section is coupled to the second seat engaging structure. The upper portion and the lower portion of the first vertical section are coupled in an adjustable, telescoping relationship, and the upper portion and the lower portion of the second vertical section are also coupled in an adjustable, telescoping relationship. In a described embodiment, the tower portion of the first vertical section and the lower portion of the second vertical section are adapted to engage a rear portion of a seat.

In an alternate embodiment, the portable seat awning further includes a flexible seat engaging member adapted to engage a chair backrest. The flexible seat engaging member includes a first frame structure receiving feature and a second frame structure receiving feature. The first frame structure receiving feature is adapted to receive and support the first frame structure, and the second frame structure receiving feature is adapted to receive and support the second frame structure.

In a more specific example, the flexible seat engaging member is a bag adapted to transport the portable seat awning. The bag includes an opening large enough to receive a chair backrest. The first frame structure receiving feature includes a first sleeve that is fixed to the bag and adapted to receive the first frame structure. The second frame structure receiving feature includes a second sleeve that is fixed to the bag and adapted to receive the second frame structure. The first seat engaging structure and the second seat engaging structure are removable from the rest of the portable seat awning, to facilitate insertion of the first frame structure and the second frame structure into the first sleeve and second sleeve, respectively.

In one embodiment, portable awning comprises a first frame structure, a second frame structure, a flexible cover, and a flexible seat engaging member. The first frame structure is disposed on a first side region of the portable awning. The second frame structure is disposed on the second side region of the portable awning. The flexible cover includes a first region and a second region. The first region of the flexible cover is coupled to the first frame structure. The second region of the flexible cover is coupled to the second frame structure. The flexible seat engaging member is adapted to engage a chair backrest. The flexible seat engaging member includes a first frame structure receiving feature and a second frame structure receiving feature. The first frame structure receiving feature is adapted to receive the first frame structure and the second frame structure receiving feature is adapted to receive the second frame structure.

In another example of the embodiment, the flexible seat engaging member is a bag operative to carry the first frame structure, the second frame structure, and the flexible cover. In an even more specific example, the bag includes an opening, a first sleeve, and a second sleeve. The opening is adapted to receive a chair backrest. The first sleeve is adapted to receive the first frame structure, and the second sleeve is adapted to receive the second frame structure. In this particular embodiment, the entire awning fits in and can be carried by the bag.

In this example of the embodiment, each of the first frame structure and the second frame structure include a vertical section and a horizontal section. The first sleeve on the bag is adapted to receive the vertical section of the first frame structure, and the second sleeve on the bag is adapted to receive the vertical section of the second frame structure. The horizontal section of the first frame structure is collapsible with respect to the vertical section of the first frame structure, and the horizontal section of the second frame structure is collapsible with respect to the vertical section of the second frame structure. The example portable seat awning further includes a collapsible horizontal section coupled between the horizontal section of the first frame structure and the horizontal section of the second frame structure.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a simplified portable awning that is adapted to mount on a bleacher/bench type seat or the back of a lawn chair. In the following description, numerous specific details are set forth (e.g., fabric types, frame elements, etc.) in order to provide a thorough understanding of the invention. Those skilled in the art will recognize, however, that the invention may be practiced apart from these specific details. In other instances, details of well-known tube manufacturing practices (e.g., tube bending, welding, etc.) and components have been omitted, so as not to unnecessarily obscure the present invention.

Figure 1:
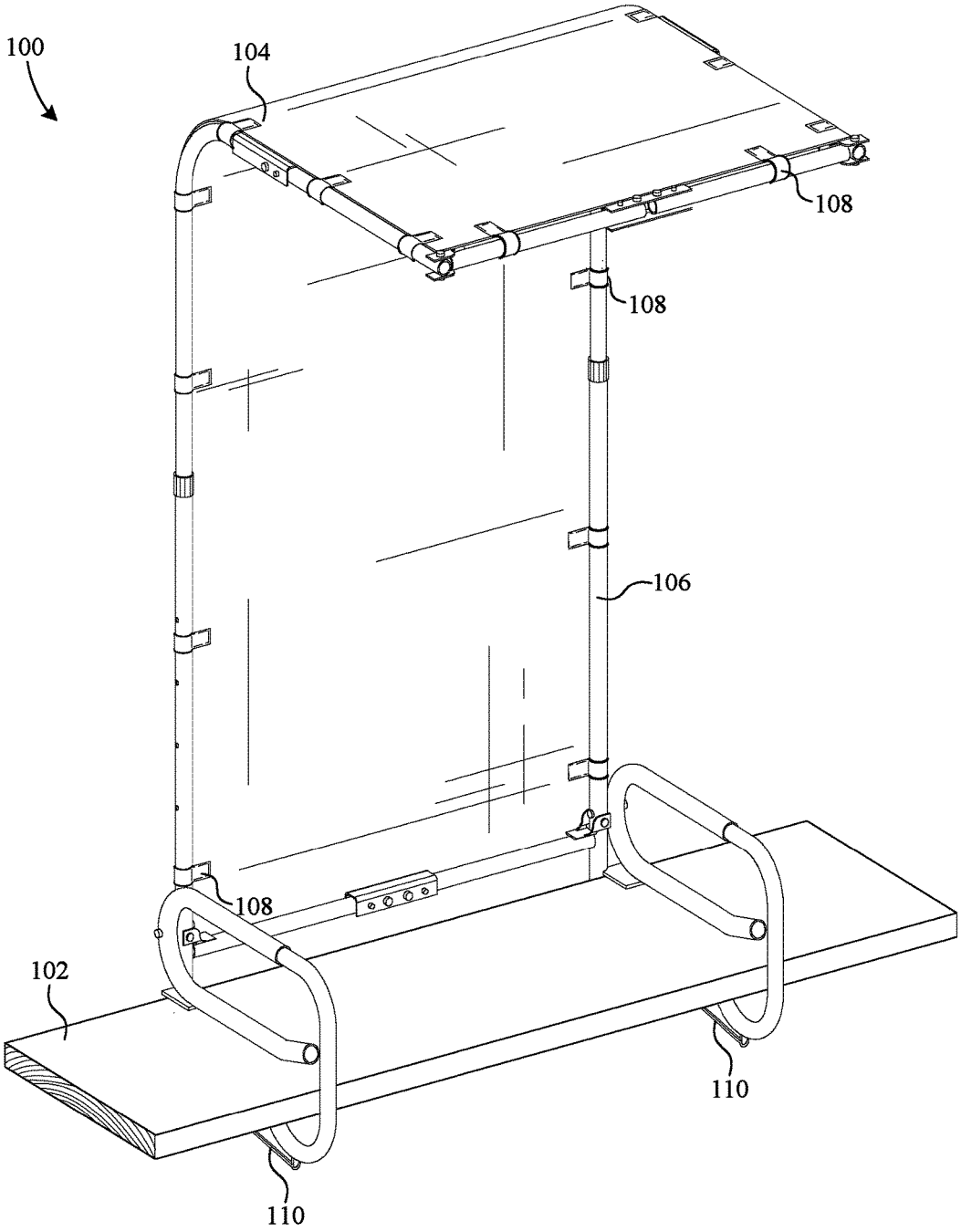
FIG. 1 is a perspective view of a portable awning.

FIG. 1 shows a perspective view of a portable seat awning 100 mounted on a seat 102 which, in this example, is a bleacher/bench type seat. Awning 100 can be universally attached to, and detached from, any suitable bleacher/bench type seat (e.g., stadium seating, picnic tables, etc.). Awning 100 includes a flexible fabric 104 coupled to a frame 106 via a plurality of fasteners 108. Fabric 104 is, for example, an opaque material that is wind and water proof. Accordingly, fabric 104 protects a user from sunlight, wind, and rain. In this particular embodiment, fasteners 108 are hook-and-loop fasteners attached to the peripheral edge of fabric 104 and wrapped around frame 106. As shown, an elastic cord (e.g., a bungee cord) 110 is used to secure frame 106 onto seat 102.

Figure 2:
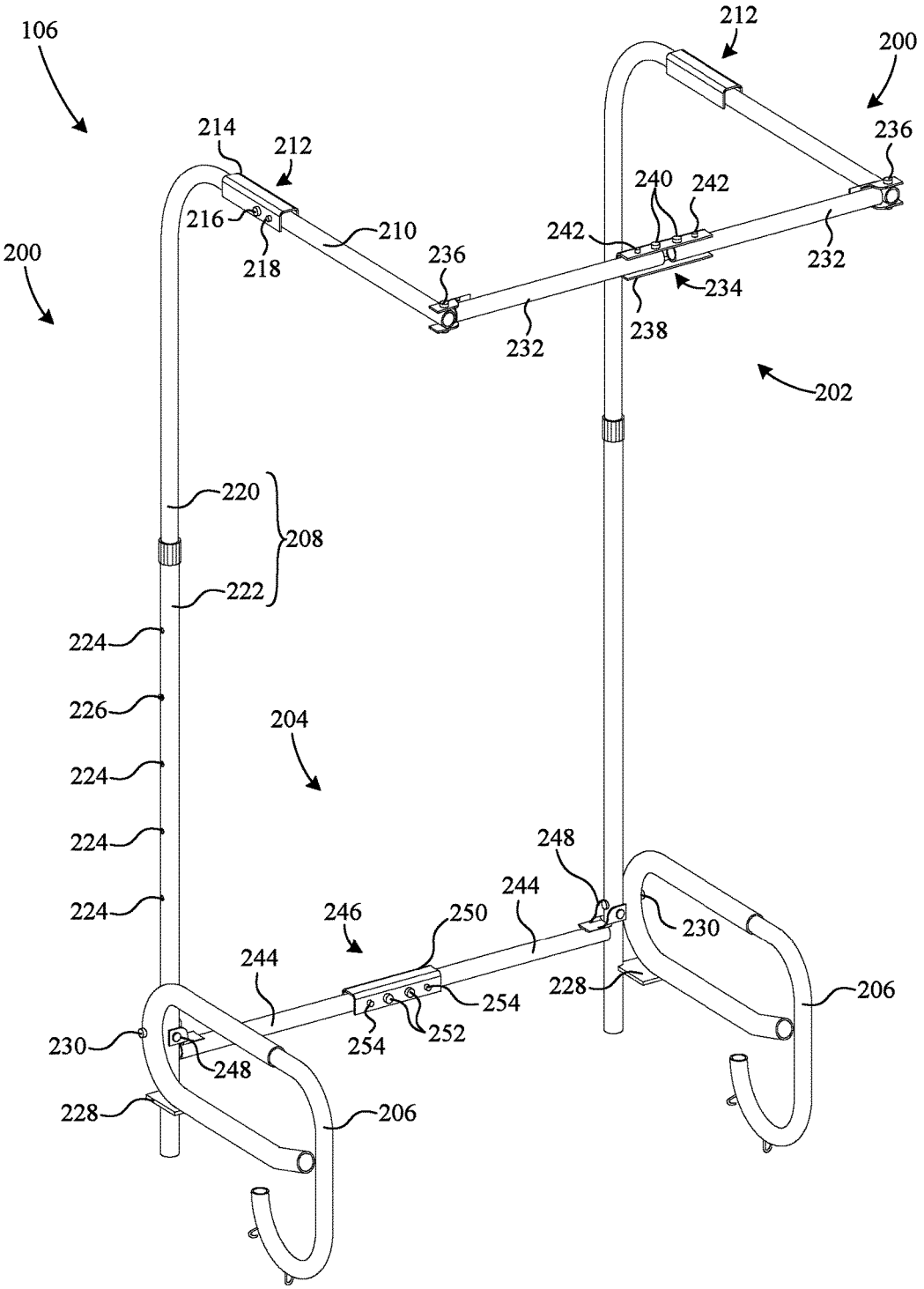
FIG. 2 is a perspective view of a frame of the portable awning of FIG. 1.

FIG. 2 shows a perspective view of frame 106 in an open/erected condition. Frame 106 includes a set of frame side structures 200, a first horizontal section 202, a second horizontal section 204, and two seat engaging structures 206. Each of frame side structures 200 includes a vertical section 208 and a horizontal section 210. Each of vertical sections 208 is coupled to a respective one of horizontal sections 210 via a respective locking feature 212. Each of locking features 212 includes a U-shaped element 214, a hinge pin 216, and a push tab 218. U-shaped element 214 is, for example, a short section of channel stock. Hinge pins 216 facilitate the pivoting of horizontal sections 210 with respect to vertical sections 208. Push tabs 218 extend from horizontal sections 210 and are shown disposed in holes formed in the sides of u-shaped elements 214.

Each vertical section 208 includes an upper portion 220 and a tower portion 222. As shown, the diameter of lower portion 222 is slightly larger than that of upper portion 220 such that upper portion 220 and tower portion 222 are coupled in a telescoping relationship. Lower portion 222 also includes a plurality of holes 224 that receive push tabs 226 of upper portion 220. Holes 224 and push tabs 226 enable the height of frame structures 200 to be adjusted according to user preference. Each of tower portions 222 further includes a plate 228 rigidly attached thereto by some suitable means such as, for example, welding. Plate 228 is adapted to engage the top surface of seat 102 while also limiting the distance at which seat engaging structures 206 can be rotated. Each of lower portions 222 are pivotally coupled to a respective one of seat engaging structures 206 via a hinge pin 230.

First horizontal section 202 includes two straight tubes 232 and a locking feature 234. Each straight tube 232 is pivotally coupled to a respective one of horizontal sections 210 via hinge elements 236. Locking feature 234 includes a U-shaped element 238, hinge pins 240, and push tabs 242. When push tabs 242 engage apertures on U-shaped element 238, first horizontal section 202 is locked in a straight condition. Hinge elements 236 and hinge pins 240 also enable first horizontal section 202 to be collapsed when push tabs 242 are pressed in to disengage the apertures of U-shaped element 238.

Second horizontal section 204 includes two straight tubes 244 and a locking feature 246. Each straight tube 244 is pivotally coupled to a respective one of lower portions 222 via hinge elements 248. Locking feature 246 includes a U-shaped element 250, hinge pins 252, and push tabs 254, and operates similar to locking feature 234 described above. Hinge elements 248 and hinge pins 252 enable second horizontal section 204 to be selectively locked or collapsed when push tabs 254 are engaged or disengaged from apertures in U-shaped element 250.

Seat engaging structures 206 are adapted to universally engage various sized bleacher/bench type seats including, for example, seat 102 of FIG. 1. As shown, seat engaging structures 206 are pivotally coupled to lower portions 222 of vertical sections 208 via hinge pins 230. In the example embodiment, seat engaging structures 206 also function as arm rests.

Figure 3:
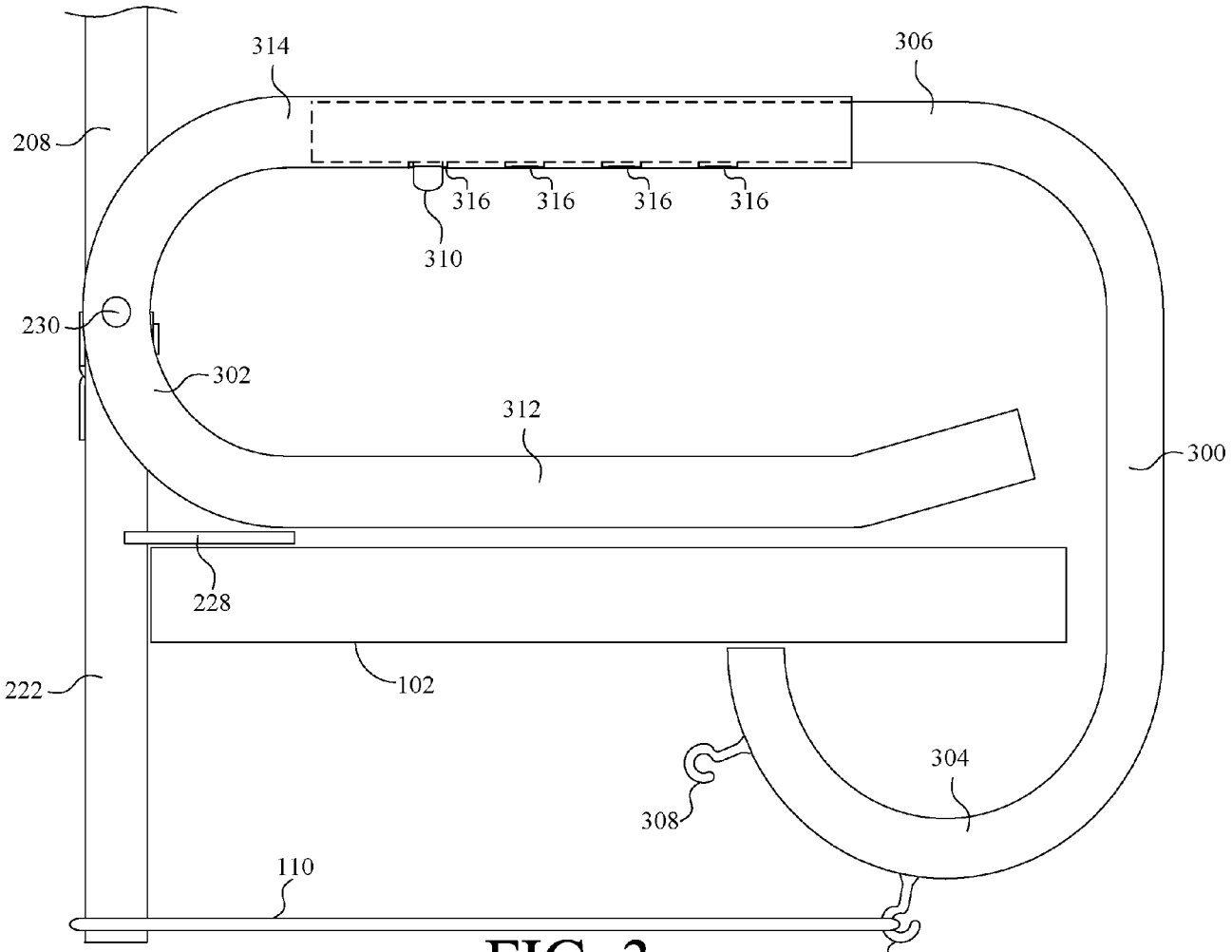
FIG. 3 is side view of a seat engaging structure of the frame of FIG. 2.

FIG. 3 is a side view of seat engaging structure 206. Seat engaging structure 206 includes a first portion 300 and a second portion 302. In the example embodiment, first portion 300 and second portion 302 are formed from bent tubing. The outer diameter of first portion 300 is less than the inner diameter of second portion 302, so that an end of first portion 300 can fit into an end of second portion 302. As shown, a segment of first portion 300 is coaxially aligned with, and inserted in, second portion 302 such that first portion 300 and second portion 302 are coupled in a telescoping fashion. First portion 300 includes a bottom region 304 and a top region 306. Bottom region 304 is curved to facilitate engagement of the rear surface of seat 102. In addition, bottom region 304 includes a set of hooks 308 extending therefrom. Hooks 308 facilitate the securement of frame 106 to seat 102 via an elastic cord 110. As shown, elastic cord 110 urges lower portion 222 of vertical section 208 toward bottom region 304 of seat engaging structure 206, thereby securing vertical section 208 in an upright position. Top region 306 includes a push tab 310 for locking first portion 300 into second portion 302 by engaging apertures 316 in second portion 302. Second portion 302 includes a bottom region 312 and a top region 314. Bottom region 312 is adapted to engage the top surface of seat 102. Top region 314 is coaxially aligned to receive top region 306 of first portion 300. As shown, top region 314 includes a plurality of apertures 316 adapted to receive push tab 316. Apertures 316 and push tab 310, together, enable the distance between first portion 300 and second portion 302 to be changed so as to adjust to various seat depths (i.e., the dimension from the front of seat 102 to the rear of seat 102).

Figure 4:
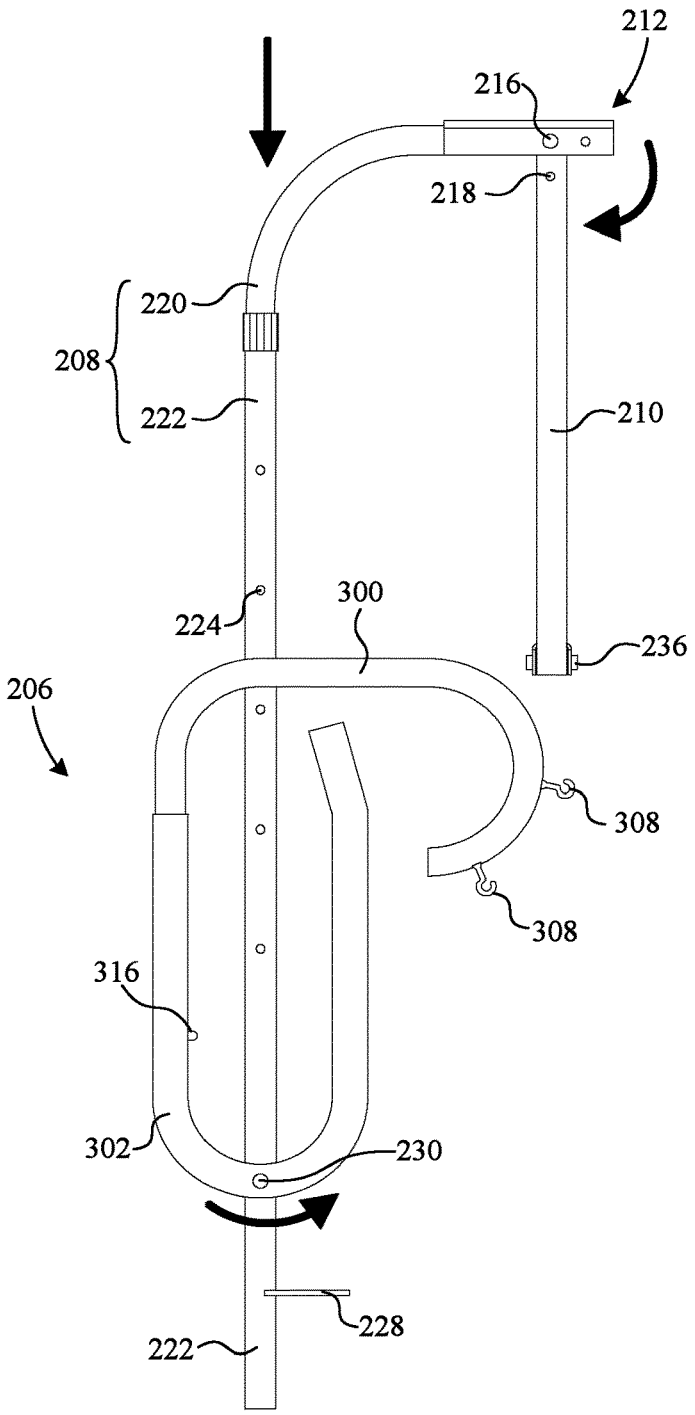
FIG. 4 is side view of the frame of FIG. 2 in a partially collapsed position.
Figure 5:
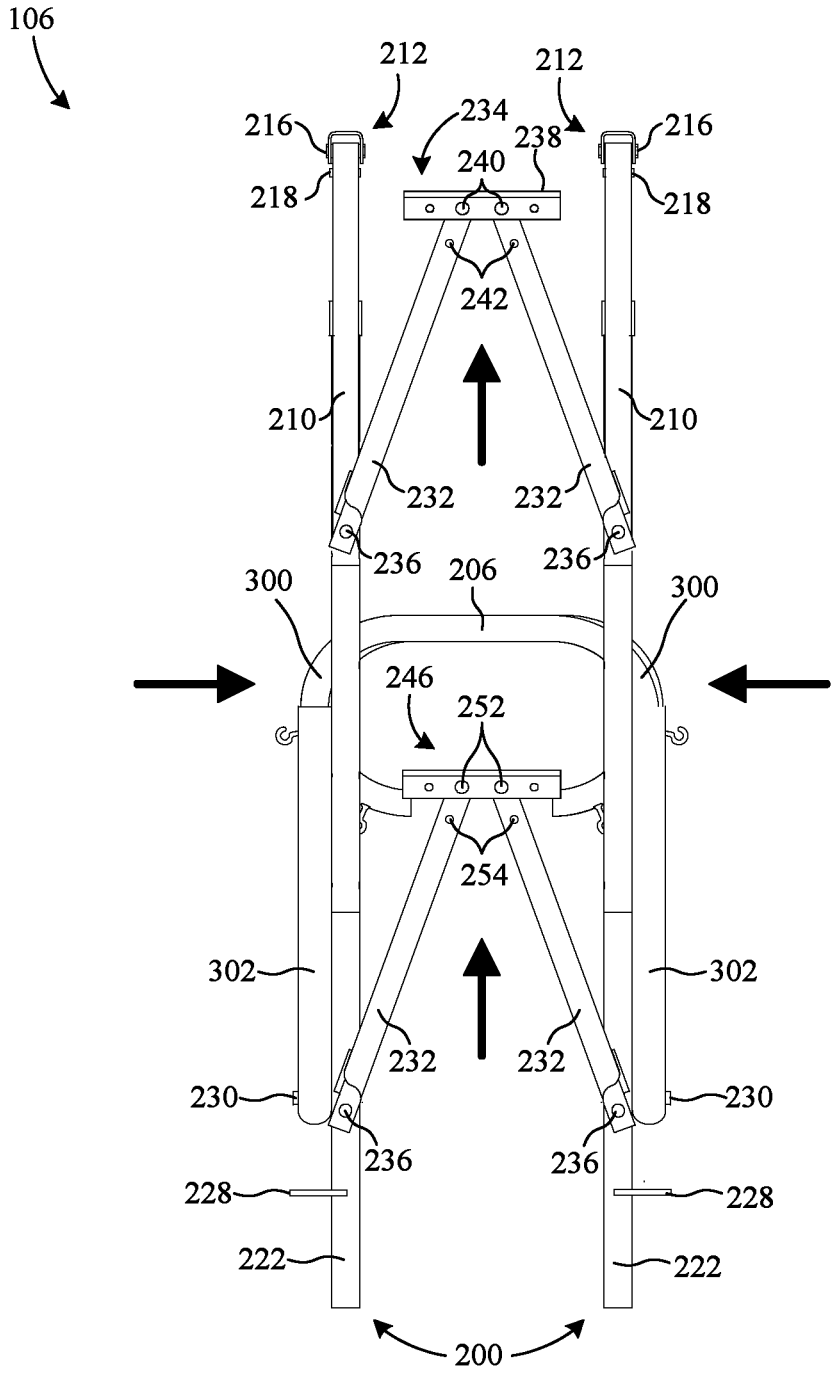
FIG. 5 is a front view of the frame of FIG. 2 in a partially collapsed position.

The collapsing of frame 106 is described with reference to FIG. 4 and FIG. 5. First, push tabs 218 are simultaneously pressed in, thereby releasing horizontal sections 210 to pivot 90° downward about hinge elements 216. Next, vertical section 208 is collapsed by pressing push tabs 226 back through holes 224 and then urging upper portion 220 of vertical section 208 into lower portion 222 of vertical section 208. Then, both seat engaging structures 206 are pivoted upward 90° about hinge element 230 as shown in FIG. 4. Next, first horizontal section 202 and second horizontal section 204 are broken down by pressing in push tabs 242 and 254 (FIG. 5). With push tabs 242 and 254 pressed in, elements 238 and 250 are urged upward thereby drawing frame side structures 200 together. Finally, first portions 300 of seat engaging structures 206 are rotated back and folded inward as shown in FIG. 5. To hold frame 106 in a collapsed position, elastic cord 112 can be wrapped around frame 106 and looped back around hooks 308.

Figure 6:
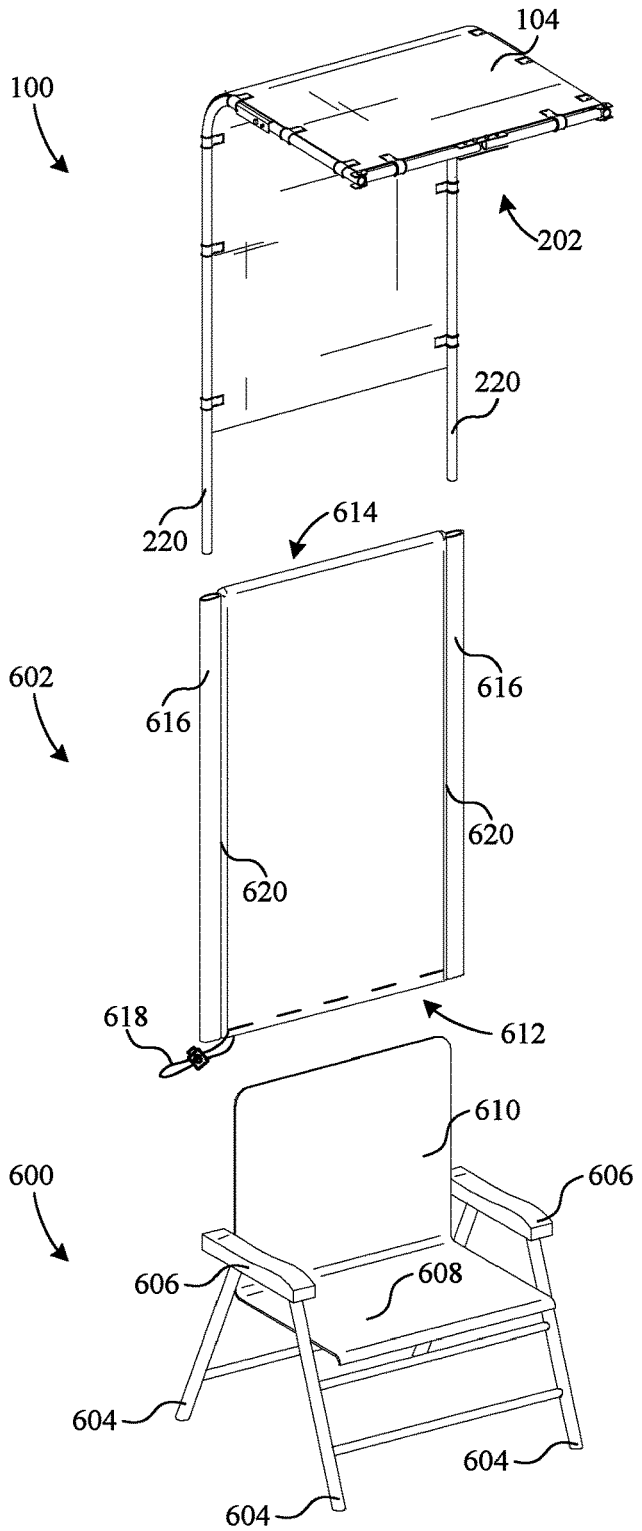
FIG. 6 is a perspective view of a portable awning according to another embodiment of the present invention.

FIG. 6 illustrates another feature of the present invention, whereby portable seat awning 100 is adapted to be mounted to a chair 600 via a bag 602. In this example, chair 600 is a foldable lawn chair that includes a set of legs 604, a set of armrests 606, a seat 608, and a backrest 610. Bag 602 facilitates the transportation of portable seat awning 100 and also facilitates the coupling of portable seat awning 100 to chair 600. Bag 602 includes an open end 612, a bottom end 614, and a set of sleeves 616. Open end 612 is sufficiently large so that portable seat awning 100 can be placed into bag 602. Additionally, open end 612 is designed to receive backrests of a variety of different sized chairs, such as backrest 610 of chair 600. Open end 612 is closable via a pull string 618. Each of sleeves 616 is formed on a respective side of bag 602 by, for example, stitching 620 that extends completely down each side of bag 602. As shown, bottom ends 614 of sleeves 616 are both open so as to receive upper portions 220 of vertical sections 208. Optionally, sleeves 616 can be fixed to the rear side of bag 602.

Figure 7:
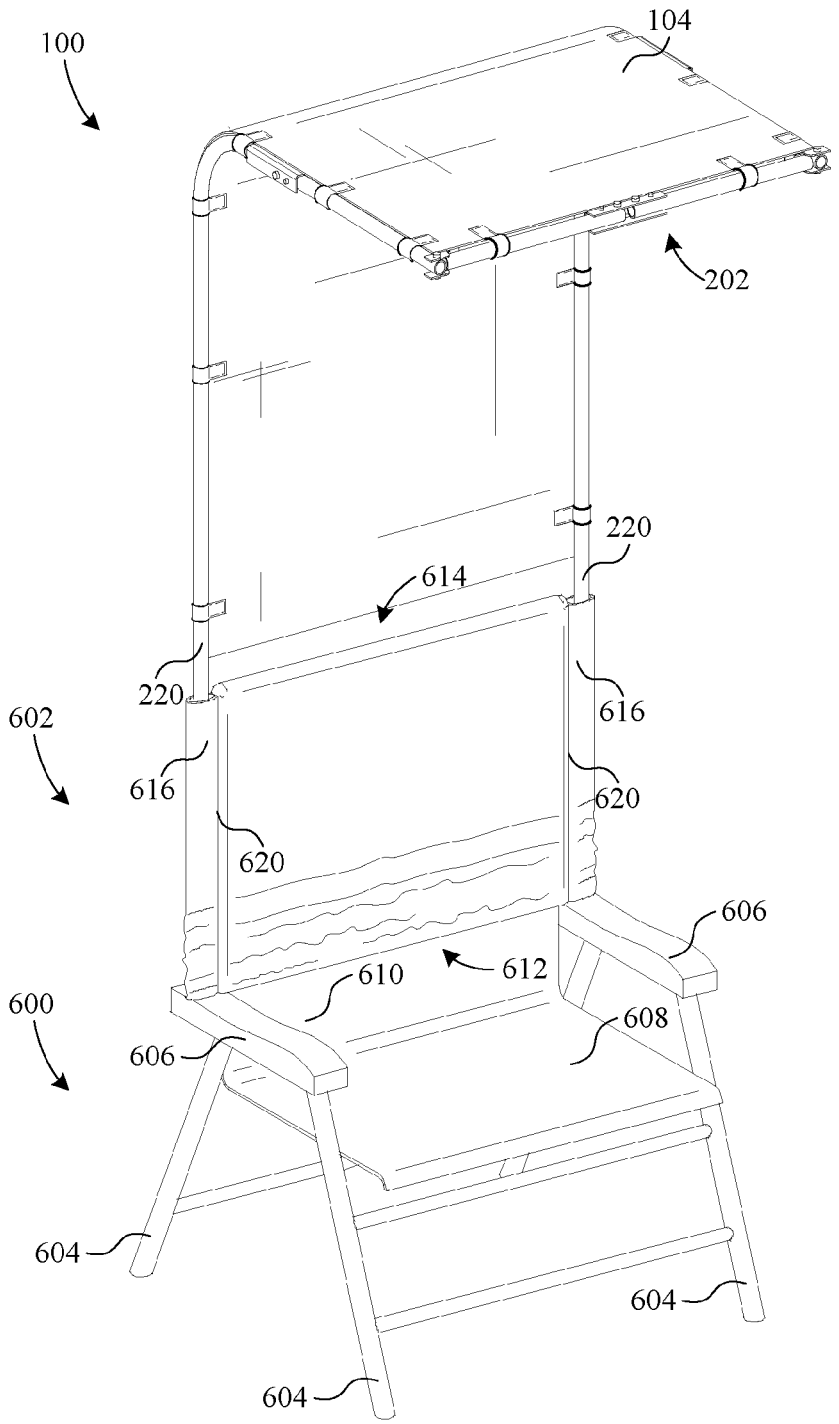
FIG. 7 is a perspective view of the portable awning of FIG. 6 coupled to a chair.

FIG. 7 shows a perspective view of portable seat awning 100 mounted to chair 600 via bag 602. The mounting of portable seat awning 100 to chair 600 via bag 602 is described as follows example. First, the top half of portable awning 100 is separated from the bottom half. That is, upper portions 220 of vertical sections 208 are removed from lower portions 222 of vertical sections 208, by pressing push tabs 226 into holes 224 while upper portions 220 and lower portions 222 are pulled in opposite directions. (See FIG. 2) Thus, seat engaging structures 206 (FIG. 2) are removed from frame 106. Then, bag 602 is placed onto chair 600 by positioning open end 612 of bag 602 around backrest 610 of chair 600. Finally, each of upper portions 220 of vertical sections 208 are inserted into a respective one of sleeves 616 as shown.

Figure 8:
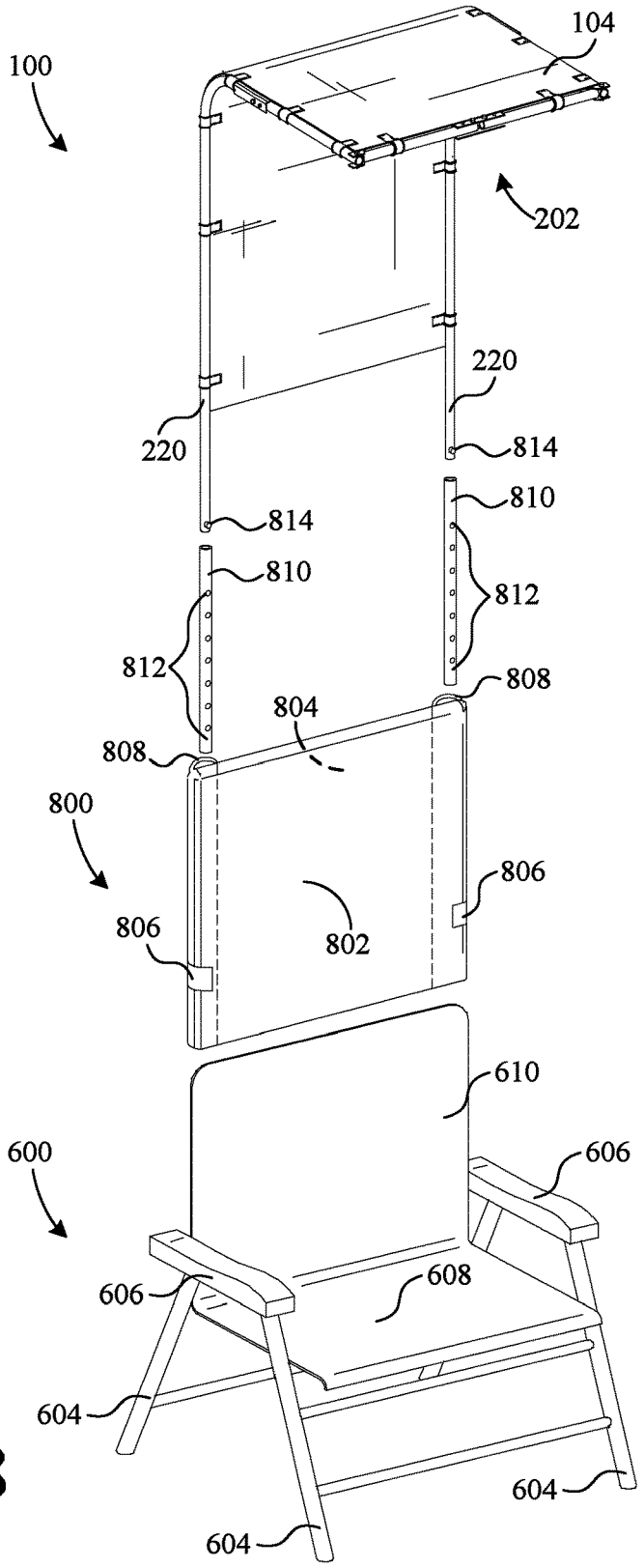
FIG. 8 is a perspective view of the portable awning of FIG. 1 according to yet another embodiment of the present invention.
Figure 9:
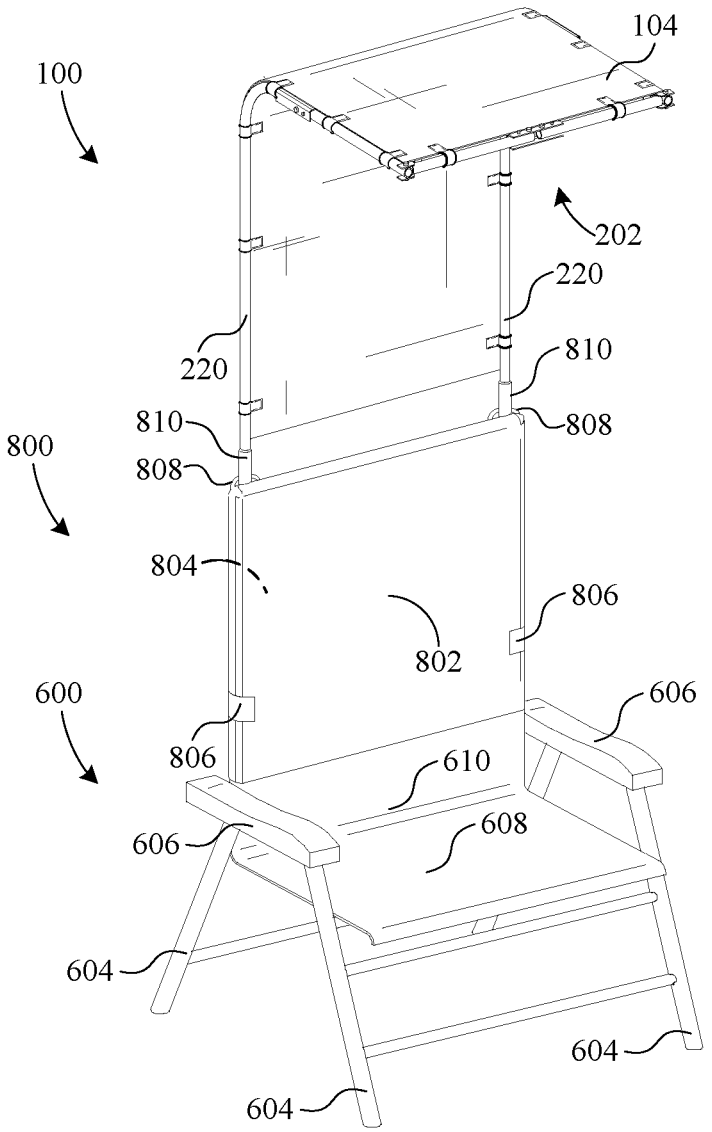
FIG. 9 is a perspective view of the portable awning of FIG. 8 coupled to a chair.

FIG. 8 and FIG. 9 illustrate another embodiment of the present invention, wherein portable seat awning 100 is adapted to be mounted to chair 600 via a fabric awning support 800. FIG. 8 shows an exploded perspective view of portable seat awning 100 removed from chair 600. FIG. 9 shows a perspective view of portable seat awning 100 coupled to chair 600.

In this example, awning support. 800 facilitates the coupling of portable seat awning 100 to chair 600. Awning support 800 includes a front region 802 and a back region 804 fastened to one another via hook-and-loop fasteners 806. During use, front region 802 and back region 804 cover (at least partially) the front and back, respectively, of backrest 610 of chair 600. Back region 804 includes a set of sleeves 808 that are adapted to receive upper portions 220 of vertical sections 208. As shown in this example, each of upper portions 220 of vertical sections 208 further includes a telescoping extension 810. Each of extensions 810 is adapted to receive a respective one of upper portions 220. Each of extensions 810 also includes a set of holes 812 that are adapted to receive a push spring 814 of upper portion 220. Accordingly, the length of upper portions 220 and, therefore, the vertical height of awning 100 are adjustable by pressing in push springs 814 and sliding upper portions 220 into and out of telescoping extensions 810.

Figures 10A, 10B, 10C:
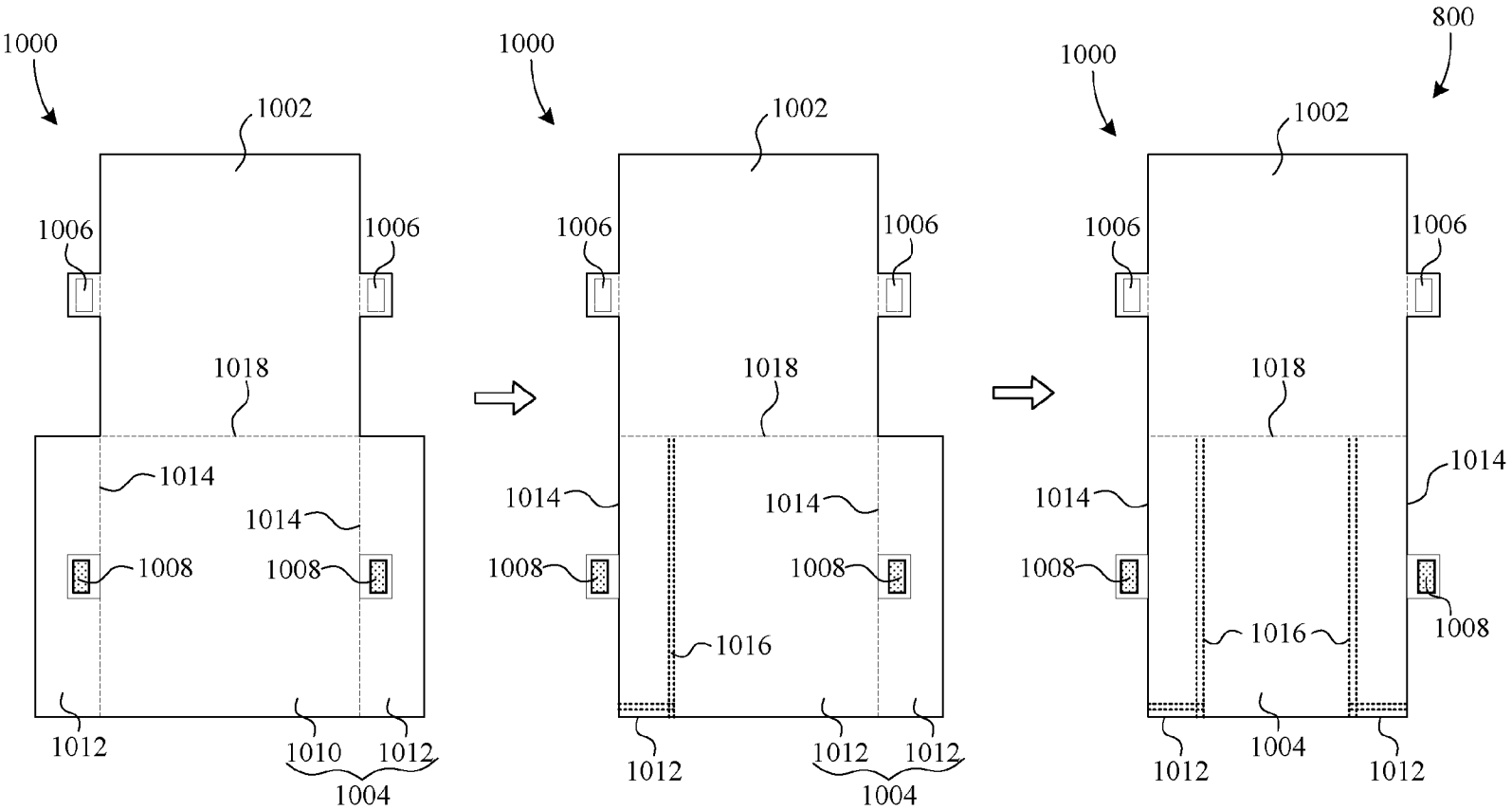
FIG. 10A illustrates the first step of manufacturing the awning support of FIG. 8.
FIG. 10B illustrates the second step of manufacturing the awning support of FIG. 8.
FIG. 10C illustrates the third step of manufacturing the awning support of FIG. 9.

FIGS. 10A through 10C illustrate the manufacturing of awning support 800.

First, as shown in FIG. 10A, a fabric blank 1000 is provided. Fabric blank 1000 includes a first region 1002 and a second region 1004, which are integral parts of a single piece of fabric. First region 1002 has attached a set of hook fasteners 1006 that are adapted to mate with a set of loop fasteners 1008 that are attached on second region 1004. Accordingly, hook fasteners 1006 and loop fasteners 1008, together, form hook and loop fasteners 806 (shown in FIG. 8). Second region 1004 includes a middle region 1010 and a set of side regions 1012 extending outwardly therefrom.

Next, as shown in FIG. 10B, a first one of sleeves 808 is formed. That is, one of side regions 1012 of second region 1004 is folded back along a folding line 1014 (shown in FIG. 10A). Then, the outer edge of the folded one of side regions 1012 is attached to middle region 1010 via stitching 1016, which also closes the bottom of sleeve 808.

Finally, as shown in FIG. 10C, a second one of sleeves 808 is formed. That is, the other of side regions 1012 of second region 1004 is folded back along the other one of folding tines 1014. Then, the outer edge of the other one of the side regions 1012 is attached to middle region 1010 via stitching 1016, which also closes the bottom of the second one of sleeves 808. It should be recognized that first region 1002 and second region 1004 of blank 1000 are formed into front region 802 and a back region 804 of awning support 800.

Once complete, awning support 800 can be attached to chair 600 by draping awning support over backrest 610 of chair 600 such that front region 802 and back region 804 are folded along a fold line 1018. When draped over backrest 610, fold line 1018 should engage the top of backrest 610. With front region 802 and back region 804 engaging the front and back, respectively, of backrest 610, hook fasteners 1006 are coupled to loop fasteners 1008. Once awning support 800 is coupled to chair 600, telescoping extensions 810 can be inserted into sleeves 808.

The description of particular embodiments of the present invention is now complete. Many of the described features may be substituted, altered or omitted without departing from the scope of the invention. For example, alternate structural elements (e.g., square stock, angle stock, etc.), may be substituted for the extruded tubular structural elements shown. As another example, alternate fabric types may be substituted for the opaque wind/rain proof fabric 104. These and other deviations from the particular embodiments shown will be apparent to those skilled in the art, particularly in view of the foregoing disclosure.

I claim:

1. A portable seat awning comprising:

a first frame structure disposed on a first side of said portable awning;

a second frame structure disposed on a second side of said portable awning;

a flexible cover having a first region and a second region, said first region of said flexible cover being coupled to said first frame structure, said second region of said flexible cover being coupled to said second frame structure; and a flexible seat engaging structure adapted to engage a chair backrest, said flexible seat engaging structure having a first frame structure receiving feature and a second frame structure receiving feature, said first frame structure receiving feature being adapted to receive said first frame structure and said second frame structure receiving feature being adapted to receive said second frame structure; and wherein said first frame structure includes a vertical section and a horizontal section, said first frame structure receiving feature being adapted to receive said vertical section of said first frame structure;

said second frame structure includes a vertical section and a horizontal section, said second frame structure receiving feature being adapted to receive said vertical section of said second frame structure;

each of said vertical section of said first frame structure and said vertical section of said second frame structure includes a selectively extendible, elongated member; and each of said first frame structure receiving feature and said second frame structure receiving feature includes an elongated pocket with an open top end and a closed bottom end.

2. The portable seat awning of claim 1, wherein said flexible seat engaging structure is a bag capable of containing said first frame structure, said second frame structure, and said flexible cover.

3. The portable seat awning of claim 1, wherein:

said horizontal section of said first frame structure is collapsible with respect to said vertical section of said first frame structure, and said horizontal section of said second frame structure is collapsible with respect to said vertical section of said second frame structure.

4. The portable seat awning of claim 1, further comprising a collapsible horizontal section coupled between said horizontal section of said first frame structure and said horizontal section of said second frame structure.

5. The portable seat awning of claim 1, wherein:

said vertical section of said first frame structure and said vertical section of said second frame structure are spaced a particular distance apart; and said first frame structure receiving feature and said second frame structure receiving feature are spaced said particular distance apart.

6. The portable seat awning of claim 1, wherein said flexible seat engaging structure is a unitary structure.

7. The portable seat awning of claim 6, wherein said flexible seat engaging structure is formed from fabric.

8. The portable seat awning of claim 1, wherein said flexible seat engaging structure includes:

a first section adapted to abut a front surface of said chair backrest;

a second section adapted to abut a back surface of said chair backrest; and an intermediate section coupled between said first section and said second section and disposed to rest upon a top surface of said chair backrest to support said flexible seat engaging structure.

9. The portable seat awning of claim 8, wherein said flexible seat engaging structure further includes:

a set of fasteners coupled to one of said first section or said second section; and a set of complimentary fasteners coupled to the other of said first section or said second section and operative to engage said set of fasteners.

10. The portable seat awning of claim 9, wherein said set of fasteners and said set of complimentary fasteners include hook-and-loop fasteners.

11. The portable seat awning of claim 1, wherein said vertical section of said first frame structure and said vertical section of said second frame structure are discrete members mechanically independent from one another.

12. The portable seat awning of claim 1, wherein:

said vertical section of said first frame structure includes a bend extending horizontally;

said vertical section of said second frame structure includes a bend extending horizontally;

said first frame structure includes a hinge assembly disposed between said bend of said vertical section of said first frame structure and said horizontal section of said first frame structure, said hinge assembly of said first frame structure including a locking feature adapted to selectively secure said horizontal section of said first frame structure in a horizontal position and release said horizontal section of said first frame structure into a collapsed position adjacent said vertical section of said first frame structure; and said second frame structure includes a hinge assembly disposed between said bend of said vertical section of said second frame structure and said horizontal section of said second frame structure, said hinge assembly of said second frame structure including a locking feature adapted to selectively secure said horizontal section of said second frame structure in a horizontal position and release said horizontal section of said second frame structure into a collapsed position adjacent said vertical section of said second frame structure.

13. The portable seat awning of claim 12, wherein said vertical section of said first frame structure and said vertical section of said second frame structure are free of a rigid cross-member therebetween below said bends.

14. The portable seat awning of claim 1, wherein:

said selectively extendible, elongated member of said first frame structure includes coaxially aligned telescoping tubes, said selectively extendible, elongated member of said first frame structure being adapted to lock said telescoping tubes in any one of a plurality of selectable discrete positions; and said selectively extendible, elongated member of said second frame structure includes coaxially aligned telescoping tubes, said selectively extendible, elongated member of said second frame structure being adapted to lock said telescoping tubes in any one of a plurality of selectable discrete positions.

15. A method of manufacturing a seat engaging structure, said method comprising:

providing a single sheet of material;

forming a first portion of said sheet to abut a front surface of a chair backrest;

forming a second portion of said sheet to abut a rear surface of said chair backrest;

forming an intermediate portion of said sheet to extend from said first portion to said second portion and disposed to rest upon a top of said chair backrest when said seat engaging structure is positioned on said chair;

forming at least two elongated pockets on said second portion of said sheet, each of said elongated pockets being configured to receive an elongated support structure and having an open top end and a closed bottom end; and attaching at least one fastener to one of said first portion and said second portion, said fastener configured to couple said first portion to said second portion around said chair backrest.

16. The method of claim 15, wherein forming said at least two elongated pockets includes forming said elongated pockets from portions of said single sheet of material along lateral edges of said second portion of said sheet.

* * * * *